US008434167B2

(12) United States Patent
Gleason et al.

(10) Patent No.: US 8,434,167 B2
(45) Date of Patent: May 7, 2013

(54) UNIVERSAL DUAL-PIVOT FACE SHIELD ASSEMBLY FOR A HARD HAT

(75) Inventors: Wayne Gleason, West Greenwich, RI (US); Raymond Curci, Smithfield, RI (US); Brett Pulito, Blackstone, MA (US)

(73) Assignee: Honeywell International Inc., Morristown, NJ (US)

( * ) Notice: Subject to any disclaimer, the term of this patent is extended or adjusted under 35 U.S.C. 154(b) by 62 days.

(21) Appl. No.: 13/292,241

(22) Filed: Nov. 9, 2011

(65) Prior Publication Data

US 2013/0031693 A1 Feb. 7, 2013

Related U.S. Application Data

(60) Provisional application No. 61/514,800, filed on Aug. 3, 2011.

(51) Int. Cl.
*A42B 3/04* (2006.01)
*A42B 3/20* (2006.01)
*A42B 3/00* (2006.01)

(52) U.S. Cl.
USPC ..... 2/418; 2/416; 2/417; 2/410

(58) Field of Classification Search ..... None
See application file for complete search history.

(56) References Cited

U.S. PATENT DOCUMENTS 2,246,442 A * 6/1941 Jackson ..... 2/8.1
2,262,449 A * 11/1941 Buegeleisen ..... 2/9
2,798,222 A * 7/1957 Evans et al. ..... 2/9
2,936,458 A * 5/1960 Luisada ..... 2/435
2,965,902 A * 12/1960 Louch ..... 2/9
3,021,527 A * 2/1962 Larsen ..... 2/8.1
3,293,660 A * 12/1966 Macklin ..... 2/9
3,373,443 A * 3/1968 Marietta ..... 2/9
4,536,892 A 8/1985 Brinkoff
6,438,763 B2 * 8/2002 Guay et al. ..... 2/424
7,007,306 B2 * 3/2006 Howard et al. ..... 2/9
7,120,939 B1 * 10/2006 Howard et al. ..... 2/416
2003/0070200 A1 * 4/2003 Crye et al. ..... 2/6.6
2003/0150048 A1 * 8/2003 Price ..... 2/431
2003/0217408 A1 * 11/2003 Fournier ..... 2/424
2005/0251890 A1 * 11/2005 Landis ..... 2/9
2006/0085882 A1 * 4/2006 Broersma ..... 2/9
2006/0236438 A1 * 10/2006 Rogers et al. ..... 2/6.7
2008/0250550 A1 * 10/2008 Bologna et al. ..... 2/425
2009/0014002 A1 * 1/2009 Krafthefer et al. ..... 128/205.18
2009/0229043 A1 * 9/2009 Cyr ..... 2/422
2010/0146679 A1 * 6/2010 Heil ..... 2/9
2010/0287688 A1 * 11/2010 Stachler et al. ..... 2/424
2011/0113519 A1 * 5/2011 Gendron et al. ..... 2/2.5

(Continued)

*Primary Examiner* — Bobby Muromoto, Jr.
(74) *Attorney, Agent, or Firm* — Barlow, Josephs & Holmes, Ltd.

(57) ABSTRACT

An improved face shield assembly universally fits to most hard hats and includes a dual-point pivot system which allows the face shield to be located in a "down" as-used position, an "up" as-used position and a "stowed" position above the hard hat. The improved face shield assembly includes three separate brackets, namely a main mounting bracket secured to the brim of a hard hat, a rotating bracket pivotably mounted to the main mounting bracket and a lens mounting bracket pivotably mounted to the rotating bracket. Spring-loaded struts stabilize and retain the lens mounting bracket in the as-used and stowed positions relative to the rotating bracket.

15 Claims, 15 Drawing Sheets

U.S. PATENT DOCUMENTS

2011/0114093 A1* 5/2011 Patil et al. ..... 128/204.19
2011/0265236 A1* 11/2011 Stoll ..... 2/9
2012/0047614 A1* 3/2012 Choi ..... 2/9
2012/0177928 A1* 7/2012 You et al. ..... 428/412
2012/0185989 A1* 7/2012 Higgins ..... 2/15
2012/0291173 A1* 11/2012 Gleason et al. ..... 2/10

* cited by examiner

UNIVERSAL DUAL-PIVOT FACE SHIELD ASSEMBLY FOR A HARD HAT

This application claims the benefit of U.S. Provisional Application No. 61,514,800, filed Aug. 3, 2011.

BACKGROUND

The present specification relates to a protective face shield assembly that is adapted to releasably mount to a hard hat. More particularly, the specification relates to an improved face shield assembly that universally fits to most hard hats and that further includes a dual-pivot system which allows the face shield to be efficiently located in a "down" as-used position, a "up" as-used position and a "stowed" position above the hard hat.

Current head gear product offerings are generally hard hat specific, i.e. they do not universally fit a variety of hard hats. Further, when the face shields of existing safety systems are rotated upwards into the unused position, they leave the shields in a position that is cantilevered in front of the hard hat, where it is cumbersome, off-balance and in the way.

SUMMARY

An improved, dual-pivot face shield assembly is universally configured for fitting to a plurality of different hard hats. The improved dual-pivot face shield assembly is comprised of three separate brackets, namely a main mounting bracket secured to the rim of the hard hat, a rotating bracket pivotably mounted to the main mounting bracket and a lens mounting bracket pivotably mounted to the rotating bracket.

The main mounting bracket includes an arcuate brow bar, a brim portion depending forwardly from the brow bar, opposing pivot bosses extending from opposing ends of the brow bar, and a plurality of mounting tabs extending downwardly and inwardly from a bottom surface of the brim portion. An elastic stretch cord having opposing ends is secured to the opposing ends of the brow bar to secure the main mounting bracket onto the hard hat. In use, the main mounting bracket is received onto a brim of the hard hat wherein the mounting tabs hook under and engage the forward edges of the brim of the hard hat and the elastic stretch cord is extended over and around the rear of the hard hat.

The rotating bracket has an arcuate body portion, opposing ends and opposing primary pivot studs extending inwardly from the opposing ends. The primary pivot studs are rotatably snap-received into pivot openings in the opposing pivot bosses on the main mounting bracket to rotatably couple the rotating bracket to the main mounting bracket. The rotating bracket is thus pivotably movable relative to the main mounting bracket between a "down" position, where the lens is in an "as-used" position, and an "up" position where the lens is tilted up, but not stowed.

The lens mounting bracket has an arcuate body portion with a lens receiving channel on the lower edge thereof, and further has opposing ends. The arcuate body portion of the lens mounting bracket is pivotably coupled to the arcuate body portion of the rotating bracket wherein the lens mounting bracket is pivotably movable relative to the rotating bracket between an "as-used" position and a "stowed" position.

To stabilize the lens mounting bracket in the "as-used" and "stowed" positions relative to the rotating bracket, a pair of stabilizer struts are captured between the respective opposing ends of the lens mounting bracket and the main mounting bracket. The stabilizer struts include an internal spring captured in compression. A first end of the strut is rotatably connected to a post extending outwardly from the outside surface of the end of the rotating bracket while the second end of the strut is rotatably connected to a post on the outside surface of the end of the lens mounting bracket. The spring is normally under compression and biases the ends of the strut outwardly to maintain the lens mounting bracket in the noted positions. As the lens mounting bracket is pivoted from one position to the other, the spring in the strut compresses, and then, once it passes a central axis, extends again and biases the ends of the strut outwardly to maintain the lens mounting bracket in the other position.

A lens is removably secured within the lens channel in the lens mounting bracket whereby the lens is movable through three different positions, namely a "down" as-used position, an "up" as-used position, and "stowed" position.

Accordingly, an objective is to provide an improved face shield assembly which universally fits most hard hats.

It is another objective to provide a face shield assembly that includes a dual pivot system which allows the face shield to move between a down "as-used" position and an up "as-used" position and further to be more efficiently located in a "stowed" position above the hard hat.

Other objects, features and advantages shall become apparent as the description thereof proceeds when considered in connection with the accompanying illustrative drawings.

BRIEF DESCRIPTION OF THE DRAWING FIGURES

The preferred embodiment will now be described further by way of example with reference to the following examples and figures, which are intended to be illustrative only and in no way limiting upon the scope of the disclosure.

DETAILED DESCRIPTION OF THE PREFERRED EMBODIMENT

An improved, dual-pivot face shield assembly is generally indicated at 10 in FIGS. 1-15. In accordance with the teachings herein, the dual-pivot face shield assembly 10 is universally configured to fit to a plurality of different hard hats such as the representative example generally indicated at 12. The dual-pivot face shield assembly is comprised of three separate brackets, namely a main mounting bracket generally indicated at 14, a rotating bracket generally indicated at 16, and a lens mounting bracket generally indicated at 18. Further, a transparent, toric safety lens 20 is removably secured to the lens mounting bracket 18.

Figure 9:
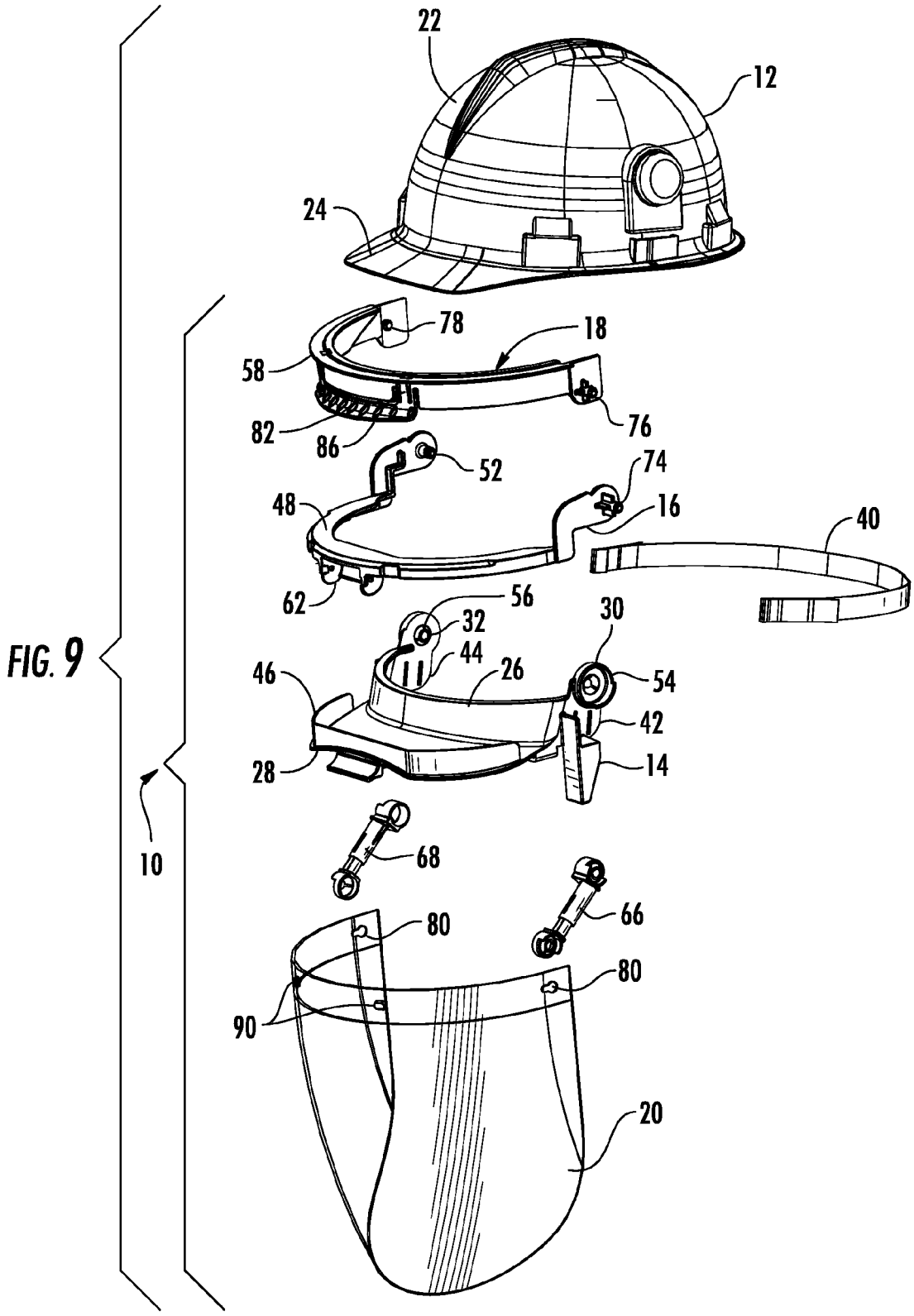
Figure 10:
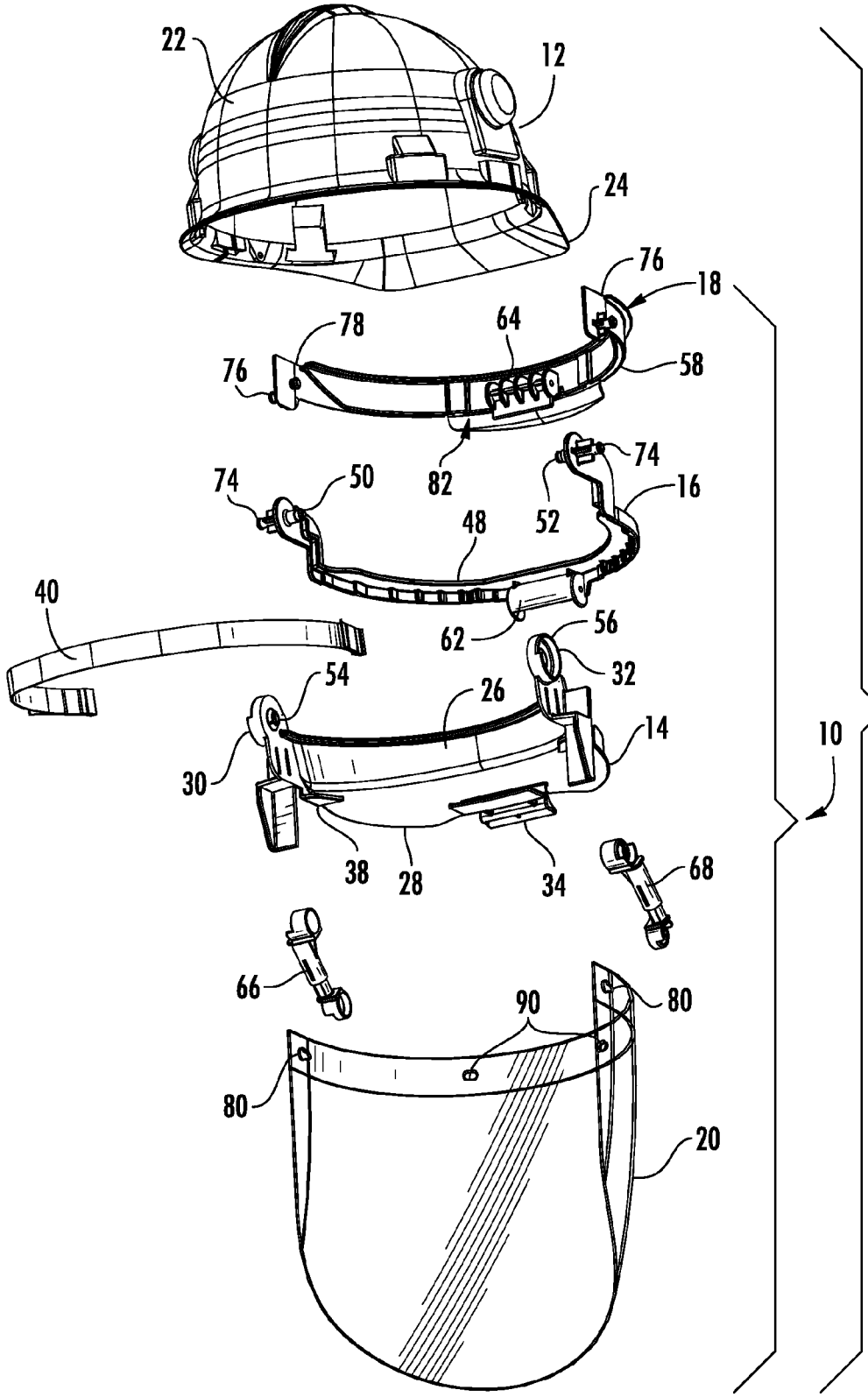
Figure 11:
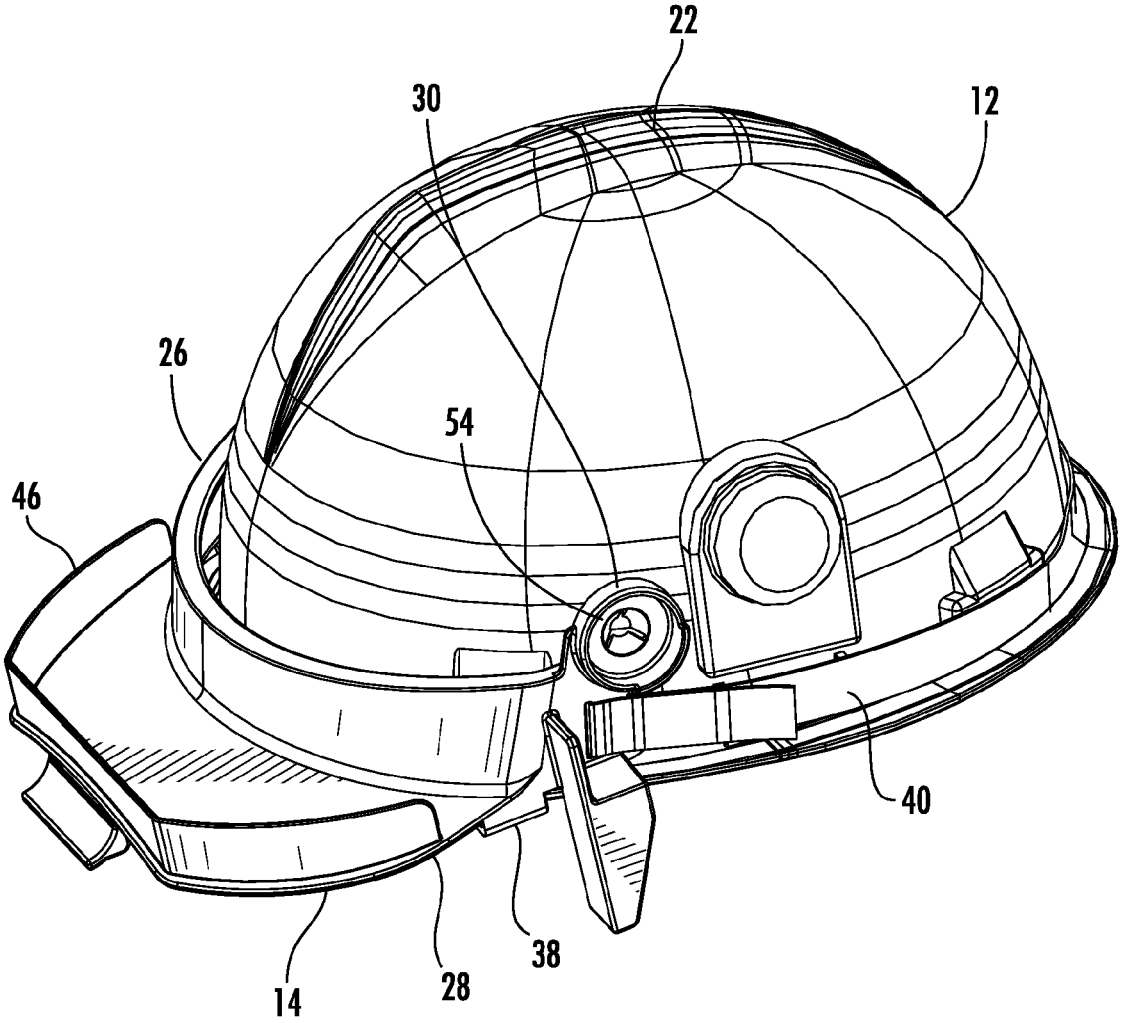
FIG. 11 is a perspective view of the main mounting bracket installed onto the hard hat.
Figure 12:
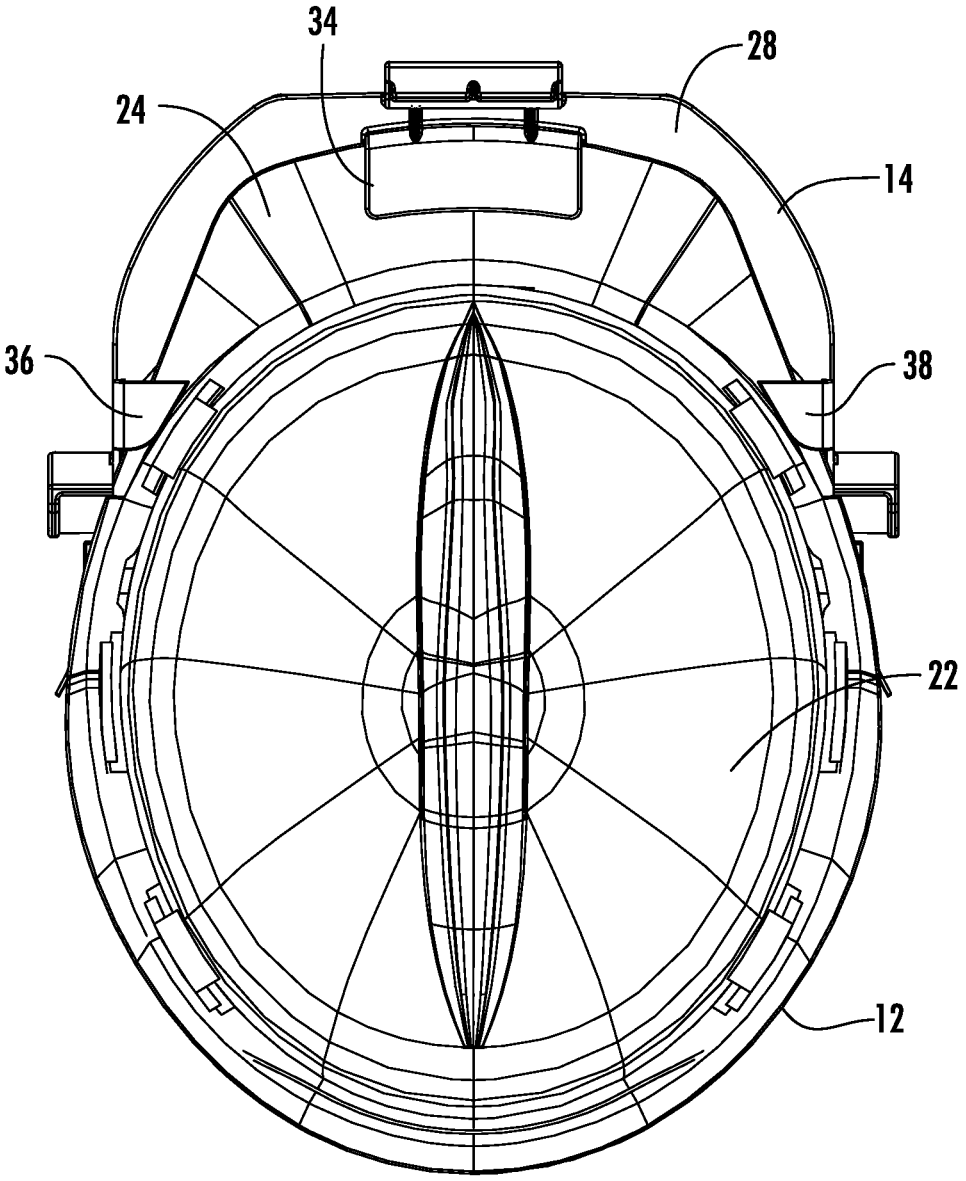
FIG. 12 is a bottom view thereof showing that mounting tabs engaged with the brim of the hard hat.
Figure 13:
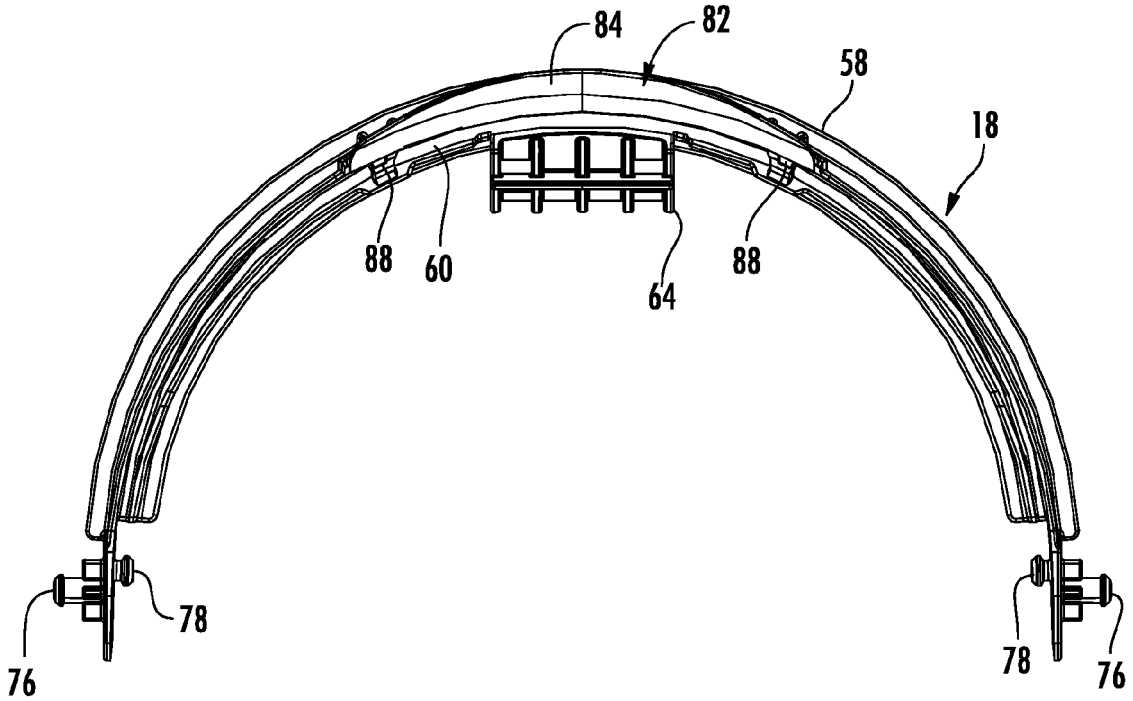
FIG. 13 is a bottom view of the lens mounting bracket.

Hard hats 12 of the type contemplated herein are well-known in the art, and generally comprise a protective dome 22 and a brim 24 extending from the front portion of the dome (See FIGS. 9, 10, 12). The hard hat 12 is maintained on the wearer's head by a conventional head gear suspension (not shown) that encircles the wearer's head. Most hard hats 12 have the same general configuration however the specific dimensions and sizes of the dome 22 and brim 24 are different. The proposed face shield assembly 10, as described herein, is configured to be universally mounted onto hard hats 12 having this basic configuration but varying dimensions.

The main mounting bracket 14 includes an arcuate brow bar 26, a brim portion 28 depending forwardly from the brow bar 26, opposing pivot bosses 30, 32 extending from opposing ends of the brow bar 26, and a plurality of mounting tabs 34, 36, 38 extending downwardly and inwardly from a bottom surface of the brim portion 28. An elastic stretch cord 40 having opposing ends is secured within slots 42, 44 in the opposing ends of the brow bar 26 to secure the main mounting bracket 14 onto the hard hat 12.

The main mounting bracket 14 is received onto the brim 24 of the hard hat 12 where the mounting tabs 34, 36, 38 hook under and engage the forward edges of the brim 24 of the hard hat 12 (FIG. 12), and the elastic stretch cord 40 is extended over and around the dome 22 at the rear of the hard hat 12. The mounting tabs 34, 36, 38 are configured so that they can accommodate a wide range of brim sizes and shapes, while the elastic stretch cord 40 pulls the mounting bracket 14 rearwardly and establishes a firm, stable fit of the main mounting bracket 14 on the brim 24 regardless of the shape of the hard hat dome 22 and shape of the brim 24.

As best seen in FIGS. 2-7, the brim portion 28 of the main mounting bracket 14 is designed in such a way to minimize or eliminate any gap between the inside of the lens 20 and the open area above the hard hat 12 on a wide range of hard hat sizes thus minimizing the ability of debris from falling in front of the wearer's eyes. Further in this regard, the peripheral edges of the brim portion 28 include an upwardly extending debris dam 46 which will retain debris captured on top of the brim portion 28 and prevent the debris from falling into the wearer's eyes when the lens 20 is raised.

Figure 1:
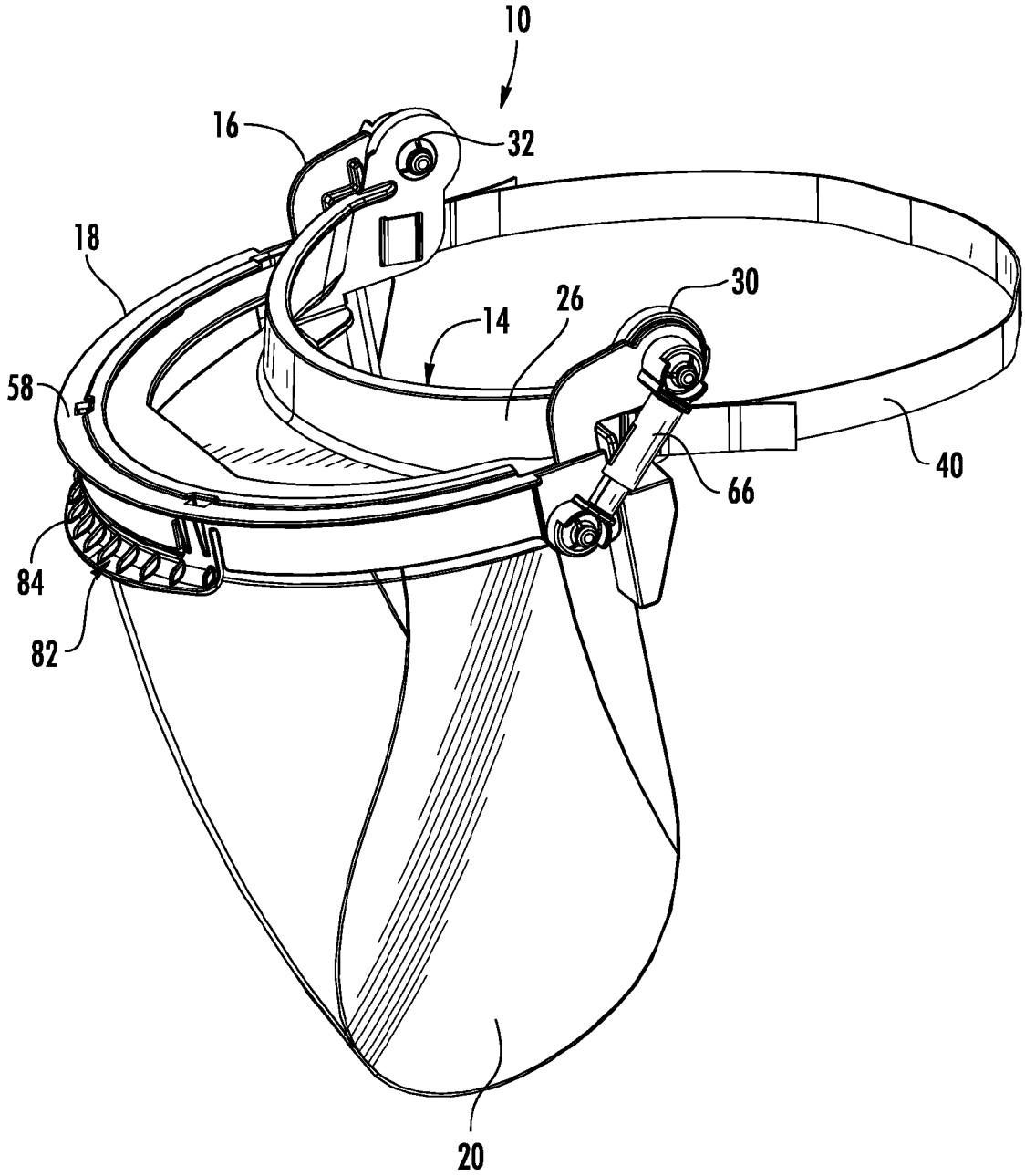
FIG. 1 is a perspective view of the face shield assembly constructed in accordance with the teachings of the present disclosure.
Figure 2:
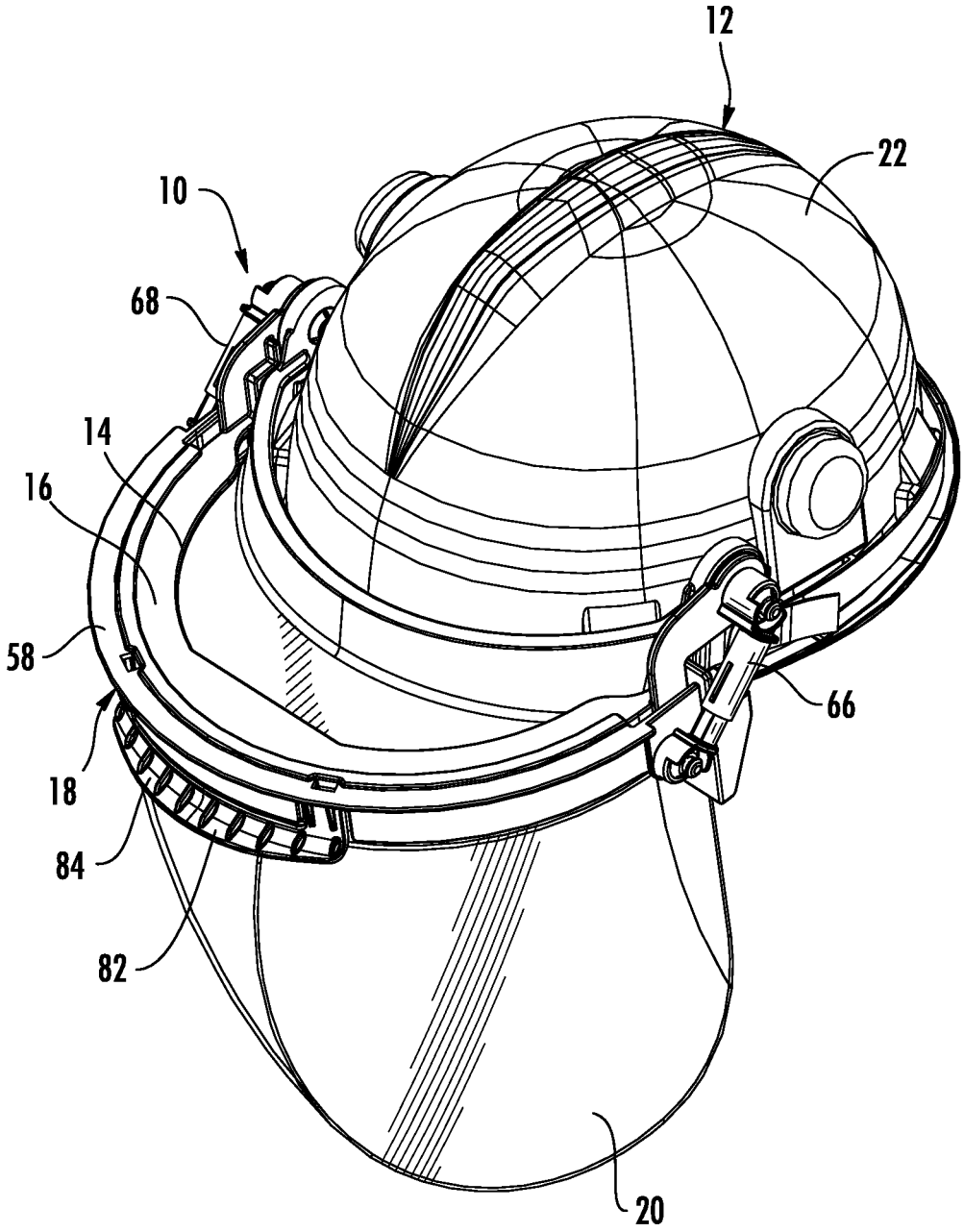
FIG. 2 is a perspective view of the face shield assembly mounted on a hard hat with the face shield in the "down" position.
Figure 3:
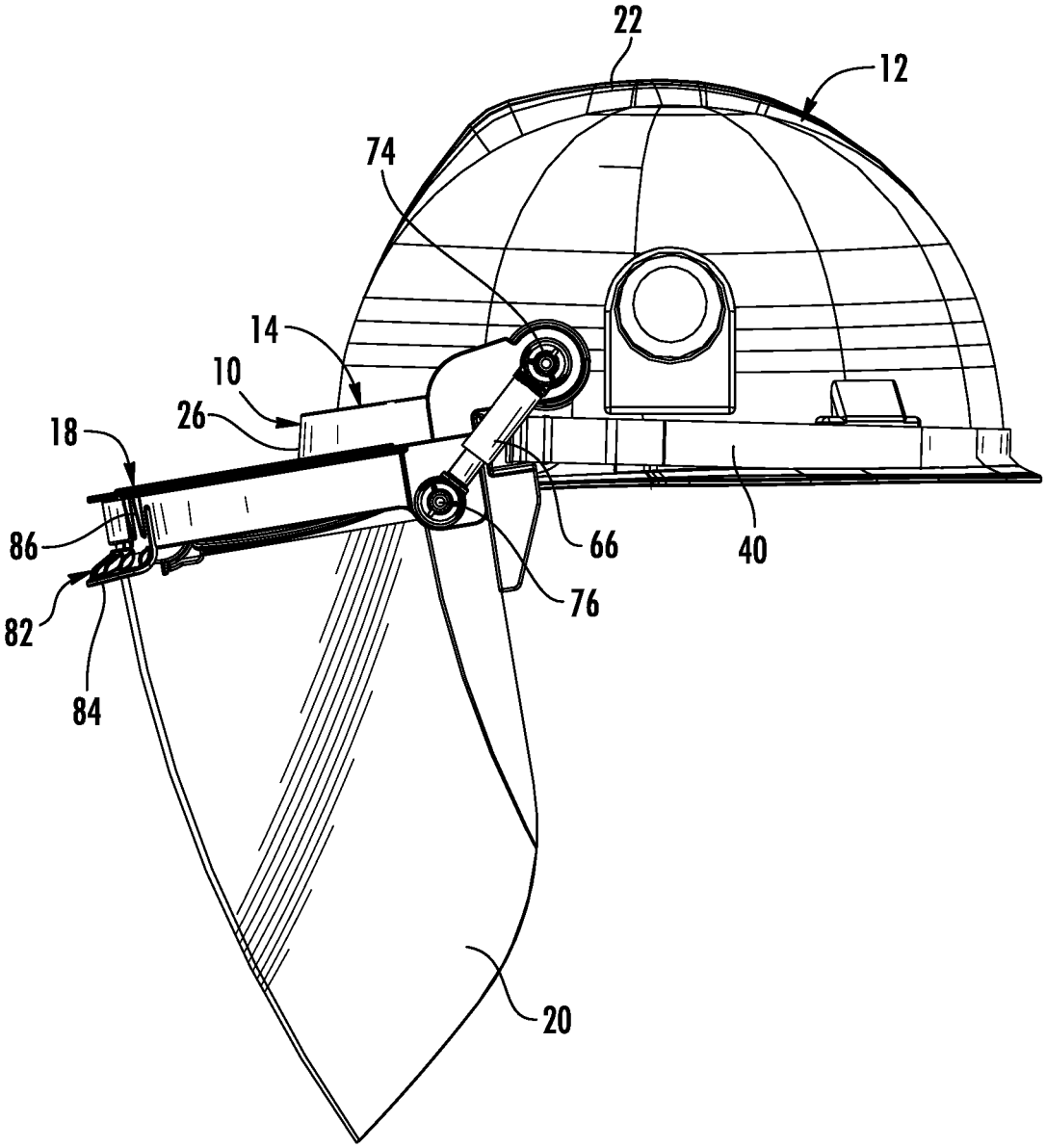
FIG. 3 is a side view thereof.
Figure 4:
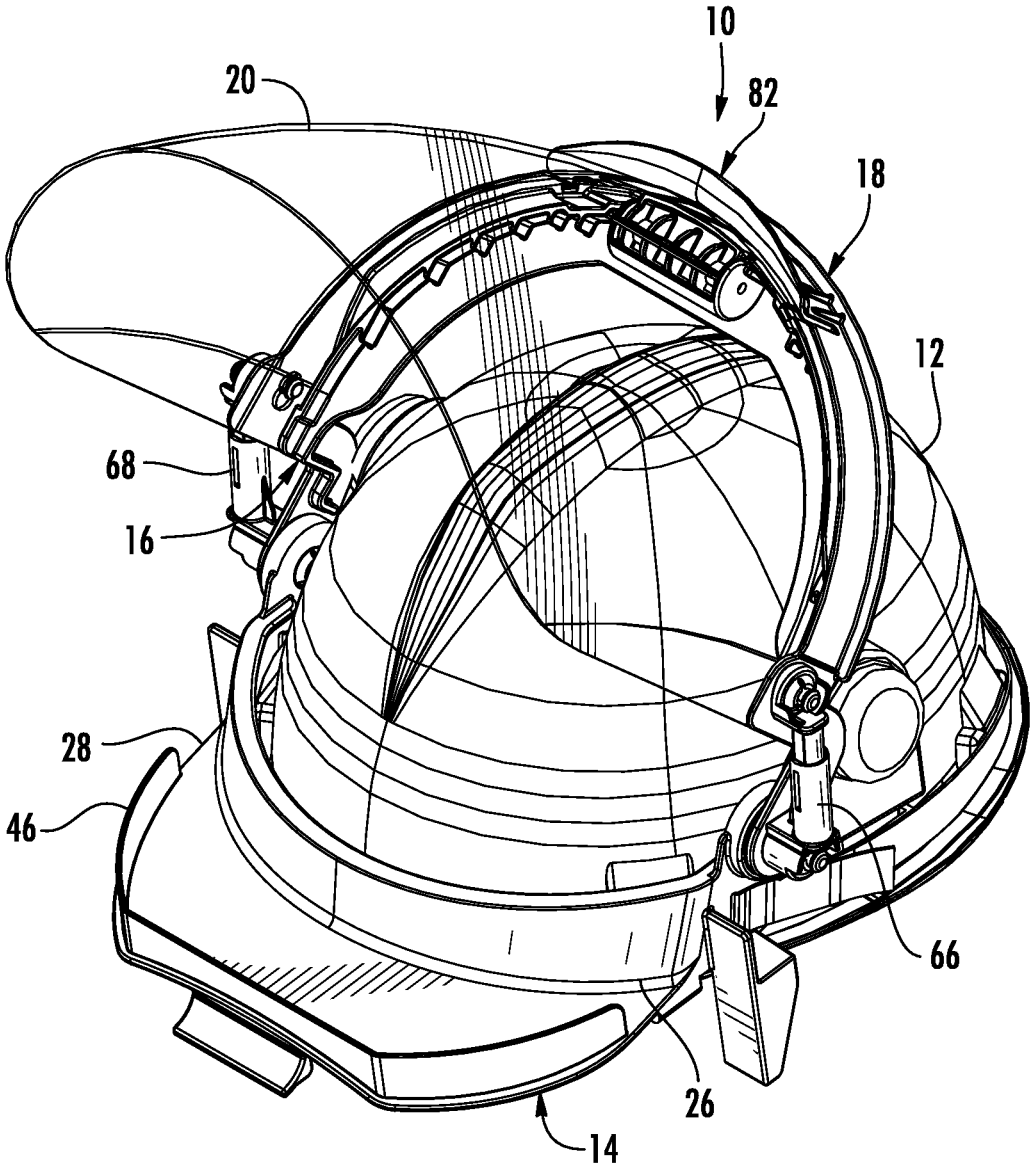
FIG. 4 is a perspective view thereof with the face shield in the "up" position.
Figure 5:
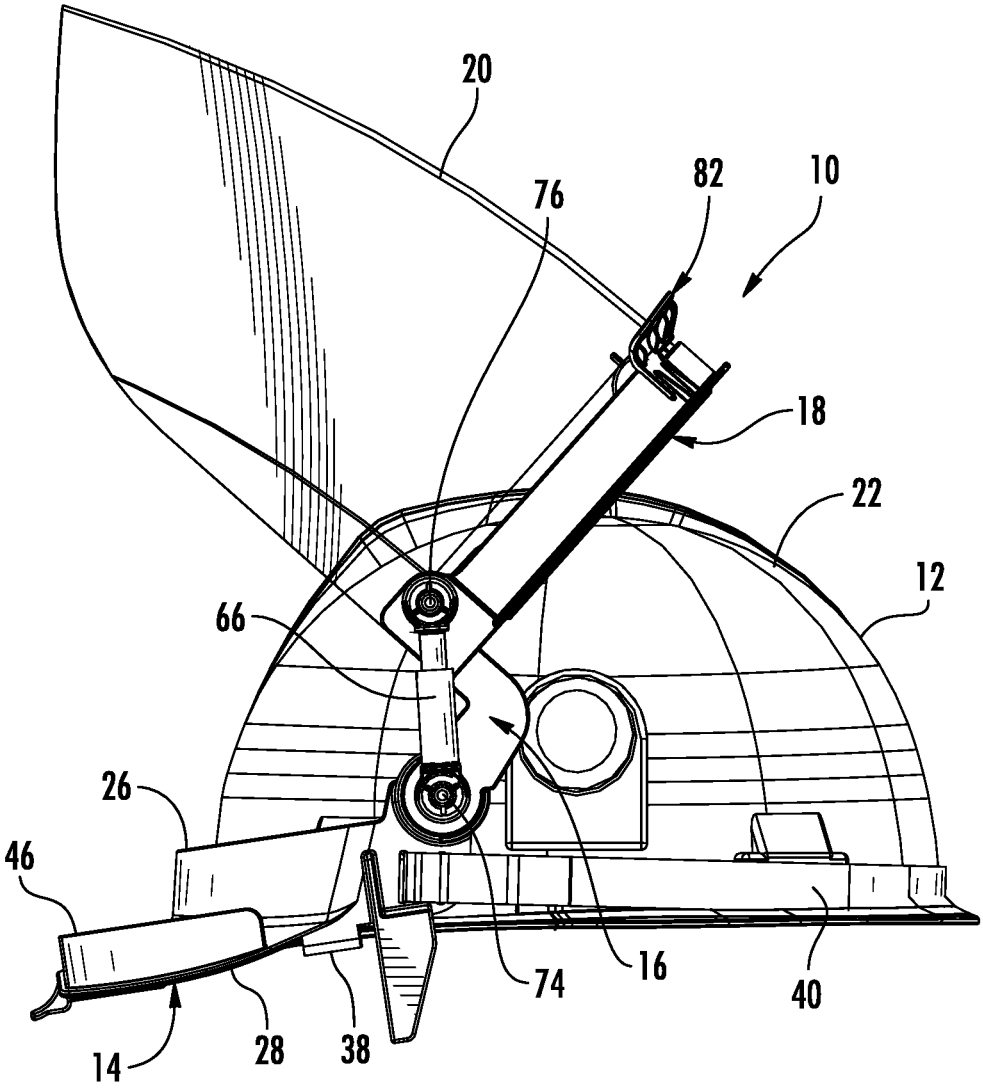
FIG. 5 is a side view thereof.
Figure 14:
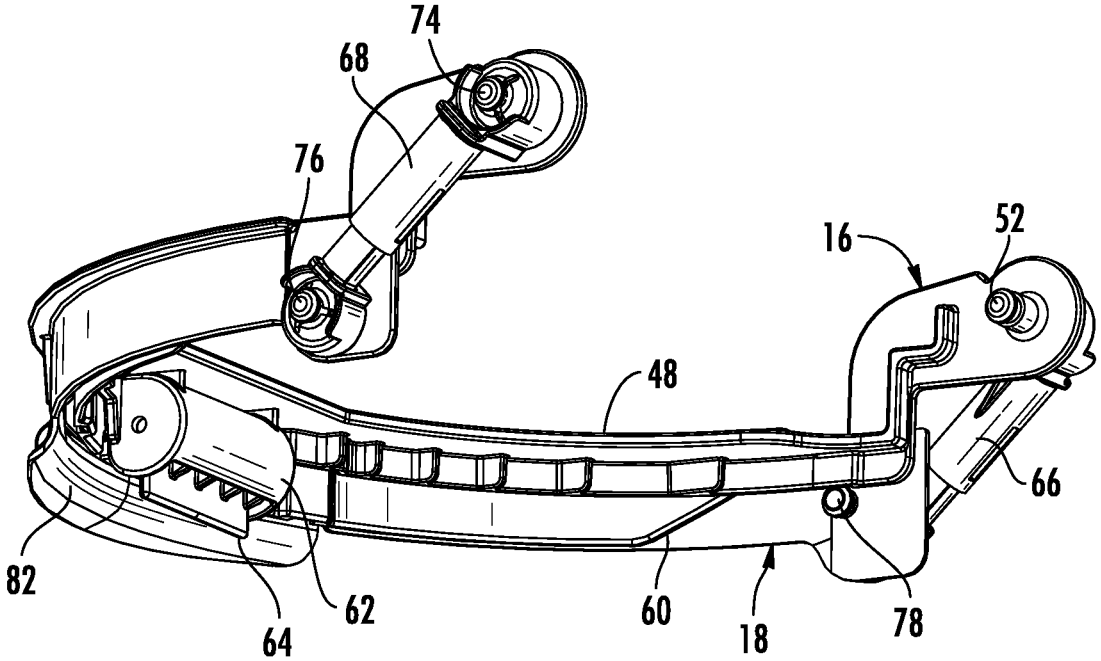
FIG. 14 is a perspective view of the lens mounting bracket and the rotating bracket as aligned when the lens is in the "up" position.

The rotating bracket 16 includes an arcuate body portion 48, opposing ends and opposing primary pivot studs 50, 52 extending inwardly from the opposing ends. The primary pivot studs 50, 52 are rotatably snap-received into pivot openings 54, 56 in the opposing pivot bosses 30, 32 on the main mounting bracket 14 to rotatably couple the rotating bracket 16 to the main mounting bracket 14. The rotating bracket 16 is thus pivotably movable relative to the main mounting bracket 14 (primary pivot) between a "down" position where the lens is in an "as-used" position (FIGS. 1-3, and 14) and an "up" position where the lens is up, but not stowed (FIGS. 4-5, and 14).

Figure 15:
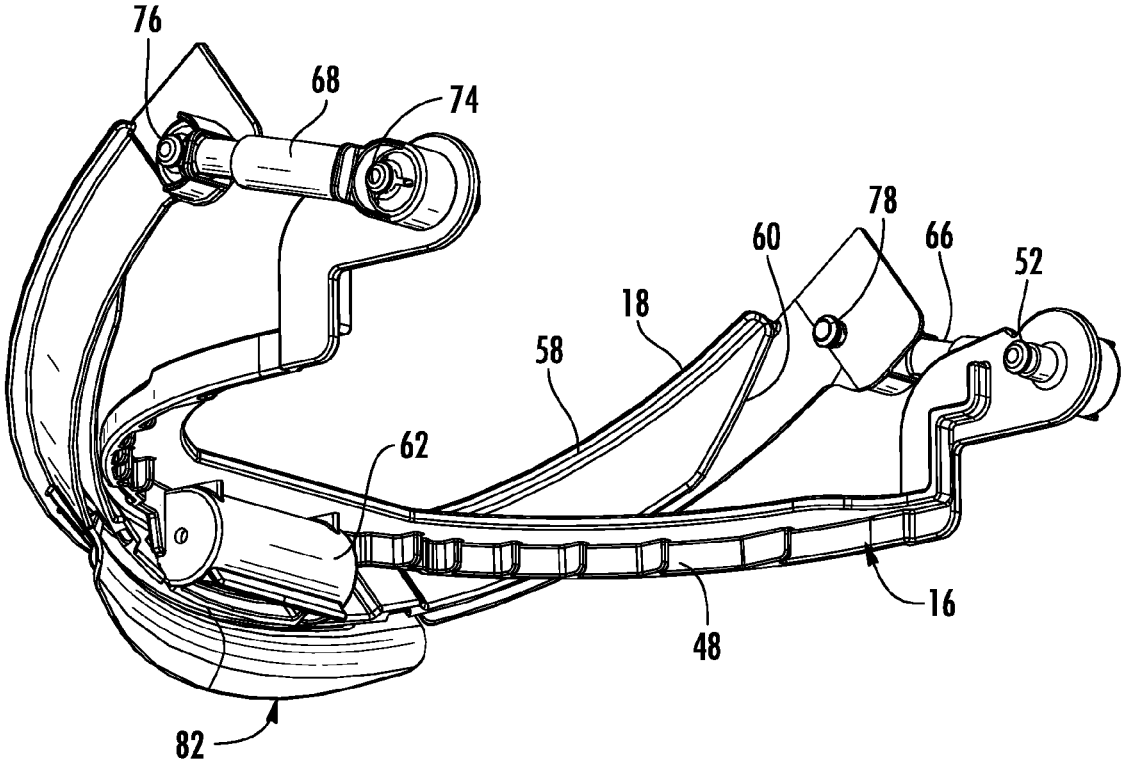
FIG. 15 is a perspective view thereof when the lens bracket is pivoted relative to the rotating bracket to locate the lens in the "stowed" position.

The lens mounting bracket 18 has an arcuate body portion 58 with a lens receiving channel 60 on the lower edge thereof, and opposing ends. The arcuate body portion 58 of the lens mounting bracket 18 is pivotably coupled to the arcuate body portion 48 of the rotating bracket 16 by interfitting pivot structures 62, 64 on the respective brackets, wherein the lens mounting bracket 18 is pivotably movable relative to the rotating bracket 16 (secondary pivot) between "as-used" position (FIGS. 4-5 and 14) and a "stowed" position (FIGS. 6-7 and 15).

To stabilize the lens mounting bracket 18 in the "as-used" (FIGS. 4-5 and 14) and "stowed" positions (FIGS. 6-7 and 15) relative to the rotating bracket 16, a pair of spring-loaded stabilizer struts 66, 68 are captured between the respective opposing ends of the lens mounting bracket 18 and the main mounting bracket 14. The stabilizer struts 66, 68 include an internal coil spring 70, 72 (See FIG. 8) captured in compression within the struts. A first (upper) end of the strut 66 is rotatably connected to a post 74 extending outwardly from the outside surface of the end of the rotating bracket 16 while the second (lower) end of the strut 66 is rotatably connected to a post 76 on the outside surface of the end of the lens mounting bracket 14. The opposing strut 68 is identical in configuration. The springs 70, 72 are normally under compression and bias the ends of the struts 66, 68 outwardly to maintain the lens mounting bracket 18 in the noted positions. As the lens mounting bracket 18 is pivoted from one position (FIG. 14) to the other (FIG. 15), the springs 70, 72 in the struts 66, 68 compress, and then, once they pass a centerline, extend again and bias the ends of the struts 66, 68 outwardly to maintain the lens mounting bracket 18 in the other position.

Figure 6:
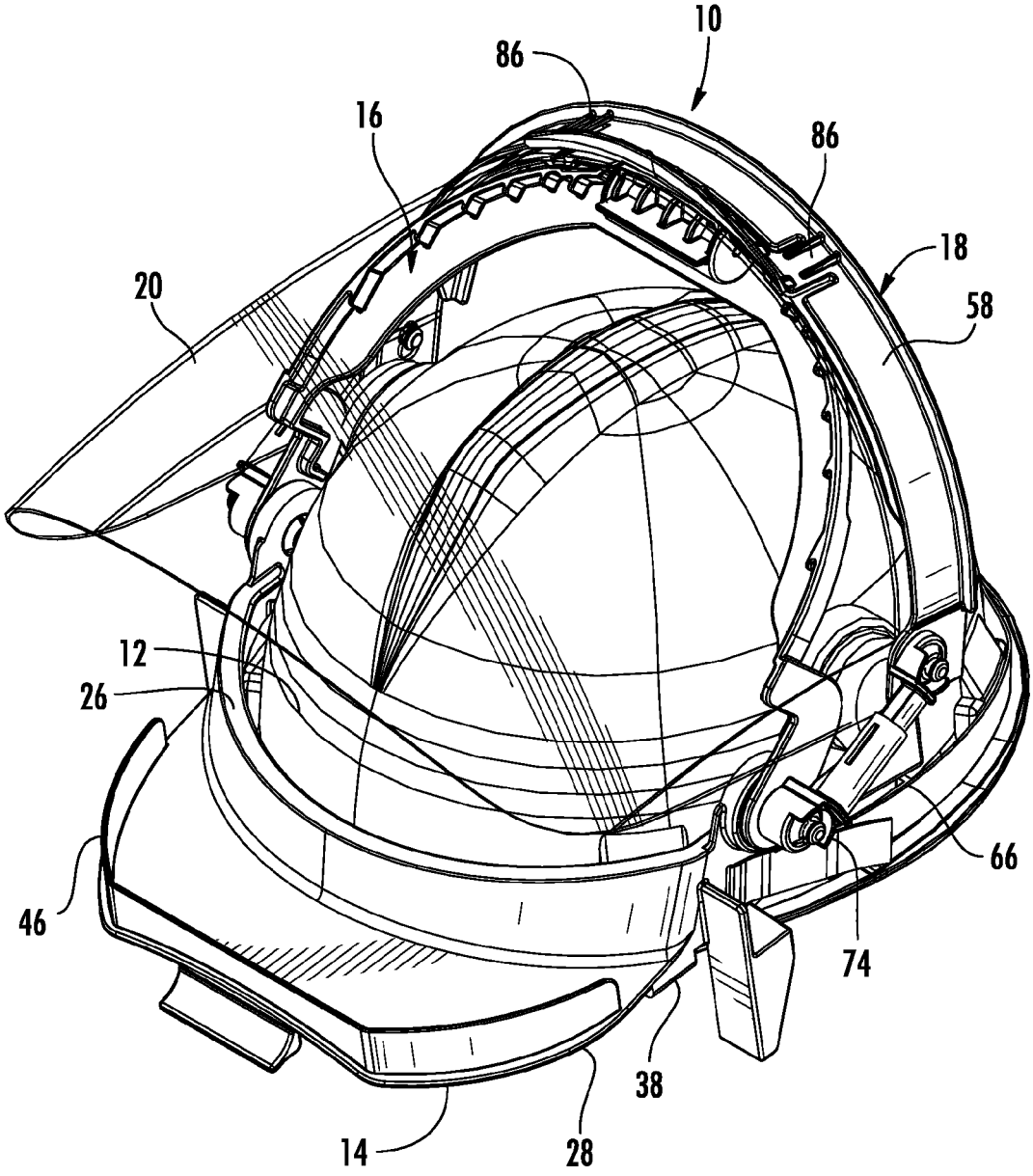
FIG. 6 is a perspective view thereof with the face shield in the "stowed" position.
Figure 7:
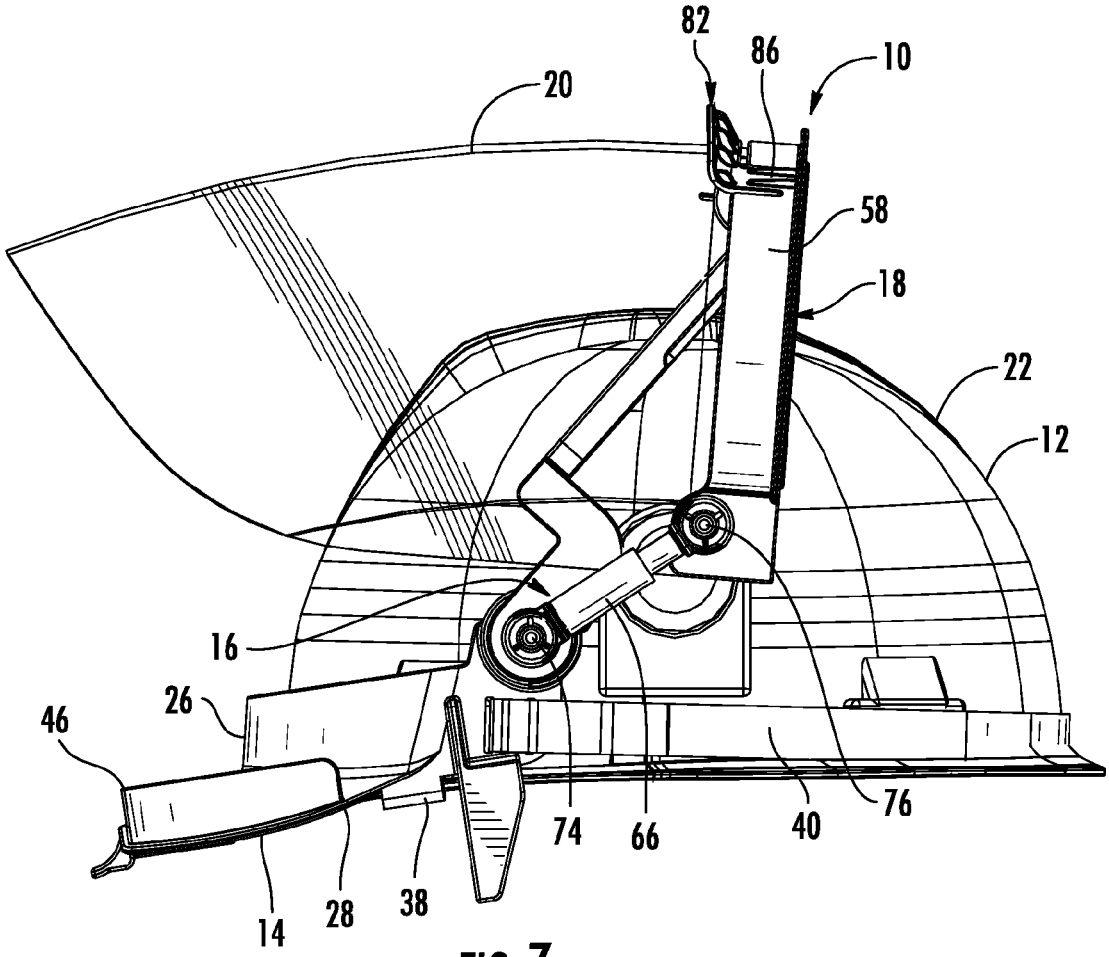
FIG. 7 is a side view thereof.

The lens 20 is removably secured within the lens channel 60 in the lens mounting bracket 18 whereby the lens 20 is movable through three different positions, namely a "down" as-used position (FIGS. 1-3), an "up" as-used position (FIGS. 4-5), and "stowed" position (FIGS. 6-7).

To secure the lens 20 to the lens mounting bracket 18, the mounting bracket 18 includes an opposing pair of inwardly extending lens studs 78. The lens studs 78 each have a cylindrical shaft, and an outer head (See FIG. 13).

The lens 20 is preferably molded from a transparent or translucent polycarbonate material. Other plastic materials and manufacturing methods for the lens are also contemplated within the scope of the disclosure.

Figure 8:
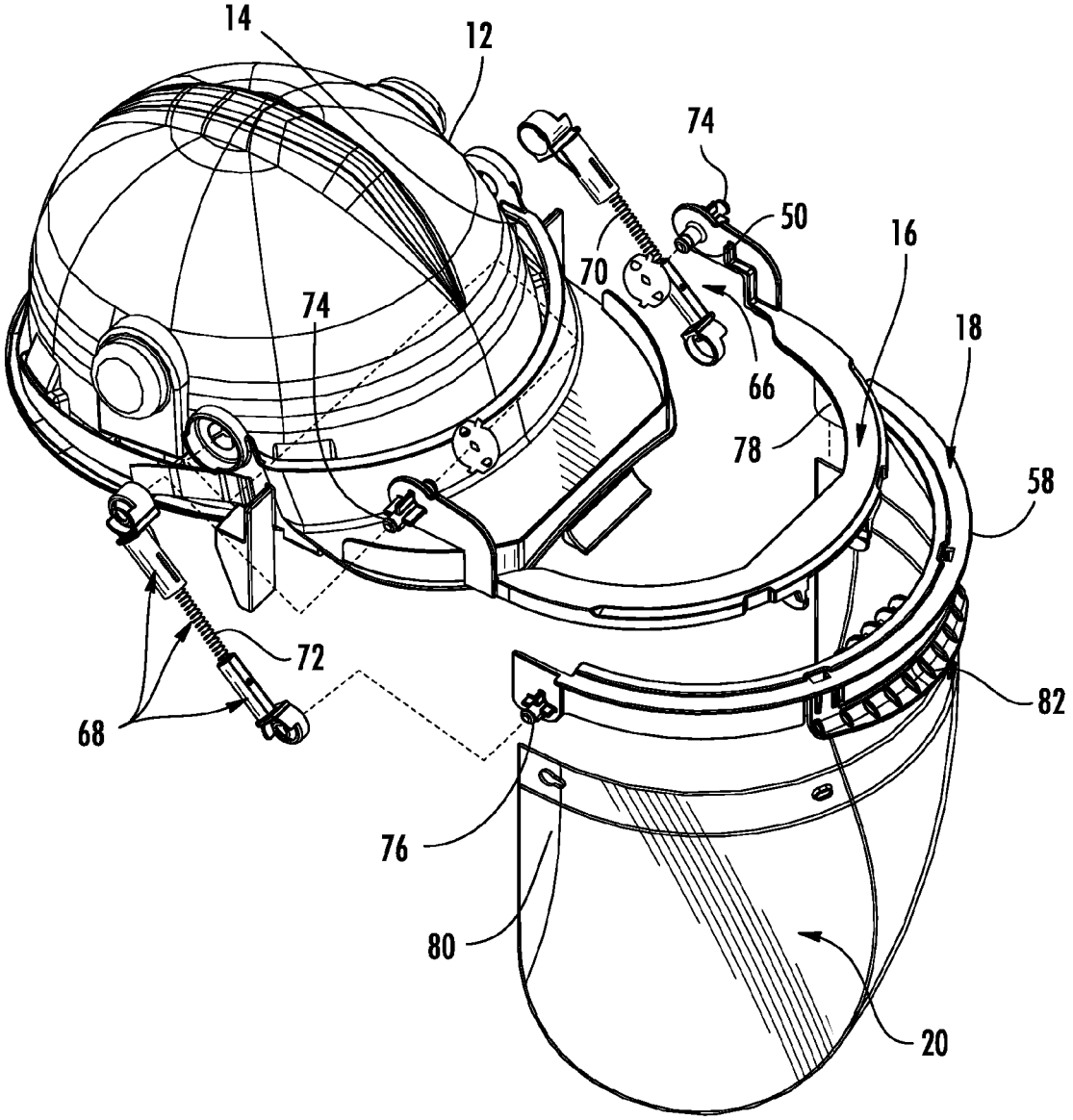
FIGS. 8-10 are exploded perspective views thereof.

Referring to FIGS. 8-10, the upper peripheral edge of the lens 20 includes an opposing pair of keyhole-shaped slots 80 adjacent its opposing side edges. The keyhole-shaped slots 80 each have a larger circular opening at the rear and a narrower slot extending forwardly from the circular opening. The circular openings are configured and arranged to receive the heads of the lens studs 78 on the lens mounting bracket 18, and then as the lens 20 is shifted rearwardly, the smaller diameter cylindrical shafts slide into the narrower slots. Once engaged, the front portion of the lens 20 is rotatable upwardly about the studs 78 where the upper peripheral edge is received into the channel 60 in the bracket 18.

While the illustrated embodiment includes interfitting studs 78 and key-hole slots 80 to provide a simplified installation of the lens 20, it should be understood that other configurations of interfitting mating formations are also possible so long as the formations on the lens 20 permit the lens to be easily interfit with the opposing formation on the bracket, and rotated into position.

The lens mounting bracket 18 further includes a latching mechanism 82 for releasably securing the lens 20. The latching mechanism 82 comprises a latch lever 84 and spring arms 86 for biasing the latch lever 84 to an engaged position. Preferably, the latch lever 84 and spring arms 86 are integrally molded as a single structure from a resilient plastic material.

The latch lever 84 is supported by the spaced spring arms 86 which depend downwardly from the bracket 18 and includes a spaced pair of rearwardly extending detents 88

(FIG. 13) which are configured and arranged to be received into corresponding openings 90 in the upper peripheral edge of the lens 20.

While the illustrated embodiment of the latching mechanism 82 is shown to utilize a pair of spaced detents and corresponding openings, it should be understood, that the latching mechanism can be implemented with a variety of detent and opening configurations so long as the engagement end includes at least one detent that engages with a corresponding opening.

In operation, the latch lever 84 is pivotably movable about the spaced arms 86 between an engaged position, wherein the detents 88 project rearwardly into engagement with the openings 90 in the upper peripheral edge of the lens 20 and a released position wherein the detents 88 are disengaged from the openings 90.

The latch lever detents 88 are maintained in engagement with the openings 90 in the lens 20 by the natural spring force of the molded plastic supporting arms 86.

For these reasons, the universal face shield assembly 10 as described herein is believed to represent a significant advancement in the art, which has substantial commercial merit.

While there is shown and described herein certain specific structure embodying the latch mechanism, it will be manifest to those skilled in the art that various modifications and rearrangements of the parts may be made without departing from the spirit and scope of the underlying concept and that the same is not limited to the particular forms herein shown and described except insofar as indicated by the scope of the appended claim.

What is claimed is:

1. A face shield assembly comprising:

a main mounting bracket configured for mounting on a hard hat, said main mounting bracket, including an arcuate brow bar, a brim portion depending forwardly from the brow bar, opposing pivot bosses extending from opposing ends of said brow bar, and at least one mounting tab extending from a bottom surface of said brim portion;

an elastic stretch cord having opposing ends respectively secured to said opposing ends of said brow bar, said main mounting bracket being received on a brim of said hard hat wherein said at least one mounting tab engages said brim of said hard hat and said elastic stretch cord extends around said hard hat;

a rotating bracket having an arcuate body portion and opposing ends, said rotating bracket being pivotably coupled to said main mounting bracket wherein said rotating bracket is pivotably movable relative to said main mounting bracket between a down position and an up position;

a lens mounting bracket having an arcuate body portion and opposing ends, said lens mounting bracket being pivotably coupled to said rotating bracket wherein said lens mounting bracket is pivotably movable relative to said rotating bracket between a usable position and a stowed position; and a lens secured to said lens mounting bracket.

2. The face shield assembly of claim 1 wherein an upper surface of said brim portion of said main mounting bracket includes a debris dam to prevent debris from falling between the hard hat and the inside of the lens.

3. The face shield assembly of claim 1 wherein said lens is removably secured to said lens mounting bracket.

4. The face shield assembly of claim 1 further comprising a stabilizer strut captured between said lens mounting bracket and said rotating bracket.

5. The face shield assembly of claim 4 wherein said stabilize strut is spring loaded and normally biased outwardly.

6. The face shield assembly of claim 2 further comprising a stabilizer strut captured between said lens mounting bracket and said rotating bracket.

7. The face shield assembly of claim 6 wherein said stabilize strut is spring loaded and normally biased outwardly.

8. The face shield assembly of claim 3 further comprising a stabilizer strut captured between said lens mounting bracket and said rotating bracket.

9. The face shield assembly of claim 8 wherein said stabilize strut is spring loaded and normally biased outwardly.

10. A face shield assembly comprising:

a main mounting bracket configured for mounting on a hard hat, said main mounting bracket, including an arcuate brow bar, a brim portion depending forwardly from the brow bar, opposing pivot bosses extending from opposing ends of said brow bar, and at least one mounting tab extending downwardly and inwardly from a bottom surface of said brim portion;

an elastic stretch cord having opposing ends respectively secured to said opposing ends of said brow bar, said main mounting bracket being received on a brim of said hard hat wherein said at least one mounting tab engages said brim of said hard hat and said elastic stretch cord extends around said hard hat;

a rotating bracket having an arcuate body portion, opposing ends and opposing primary pivot studs extending inwardly from said opposing ends, said primary pivot studs being rotatably received into pivot openings in said opposing pivot bosses, said rotating bracket being pivotably coupled to said main mounting bracket wherein said rotating bracket is pivotably movable relative to said main mounting bracket between a down position and an up position;

a lens mounting bracket having an arcuate body portion and opposing ends, said arcuate body portion of said lens mounting bracket being pivotably coupled to said actuate body portion of said rotating bracket wherein said lens mounting bracket is pivotably movable relative to said rotating bracket between a usable position and a stowed position;

a stabilizer strut captured between said lens mounting bracket and said main mounting bracket; and a lens secured to said lens mounting bracket.

11. The face shield assembly of claim 10 comprising a pair of stabilizer struts captured between opposing ends of said lens mounting bracket and opposing ends of said main mounting bracket.

12. The face shield assembly of claim 11 wherein said pair of stabilizer struts are spring loaded and normally biased outwardly.

13. The face shield assembly of claim 10 wherein said lens is removably secured to said lens mounting bracket.

14. The face shield assembly of claim 11 wherein said lens is removably secured to said lens mounting bracket.

15. The face shield assembly of claim 12 wherein said lens is removably secured to said lens mounting bracket.

* * * * *